US010186803B1

(12) United States Patent
Hocevar et al.

(10) Patent No.: US 10,186,803 B1
(45) Date of Patent: Jan. 22, 2019

(54) ELECTRICAL CONNECTOR WITH CONNECTOR LOCK

(71) Applicant: Delphi Technologies, LLC, Troy, MI (US)

(72) Inventors: Erika M. Hocevar, Southington, OH (US); Bart N. Caldwell, West Farmington, OH (US); Christopher A. Margrave, Ashtabula, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/946,343

(22) Filed: Apr. 5, 2018

(51) Int. Cl.
*H01R 13/627* (2006.01)
*H01R 13/635* (2006.01)

(52) U.S. Cl.
CPC ..... *H01R 13/6273* (2013.01); *H01R 13/635* (2013.01)

(58) Field of Classification Search
CPC ..... H01R 13/6271; H01R 13/6272; H01R 13/6275–13/6278; H01R 13/6582
USPC ..... 439/353, 354, 357, 358
See application file for complete search history.

(56) References Cited

U.S. PATENT DOCUMENTS

| | | | | |
|---|---|---|---|---|
| 5,399,045 | A * | 3/1995 | Yoneda | H01R 13/5219 403/321 |
| 5,624,272 | A * | 4/1997 | Ohsumi | H01R 13/6272 439/353 |
| 7,232,329 | B1 * | 6/2007 | Wu | H01R 12/62 439/358 |
| 8,777,651 | B2 * | 7/2014 | Miyawaki | H01R 13/6272 439/354 |
| 2006/0160433 | A1 | 7/2006 | Machida et al. | |

* cited by examiner

*Primary Examiner* — Hien Vu
(74) *Attorney, Agent, or Firm* — Robert J. Myers

(57) ABSTRACT

A connector assembly includes a first-connector and a second-connector. The first-connector has a locking-lug. The second-connector has a cantilevered latch configured to slideably engage the locking-lug. The cantilevered latch includes a pair of parallel latch-arms. The pair of parallel latch-arms terminate at a first cross-beam that spans the pair of parallel latch-arms. The cantilevered latch further includes a second cross-beam parallel to the first cross-beam. The second cross-beam is configured to releasably lock the locking-lug when the first-connector is mated with the second-connector. The pair of parallel latch-arms includes a rib extending beyond a bottom-surface of each individual latch-arm. The locking-lug deflects the pair of parallel latch-arms toward an outer-surface of the second-connector when first-connector is moved from an unmated-position to a mated-position, whereby the rib contacts the outer-surface and limits a deflection of the pair of parallel latch-arms.

13 Claims, 5 Drawing Sheets

ELECTRICAL CONNECTOR WITH CONNECTOR LOCK

TECHNICAL FIELD OF INVENTION

This disclosure generally relates to an electrical connector, and more particularly relates to an electrical connector with a connector lock.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
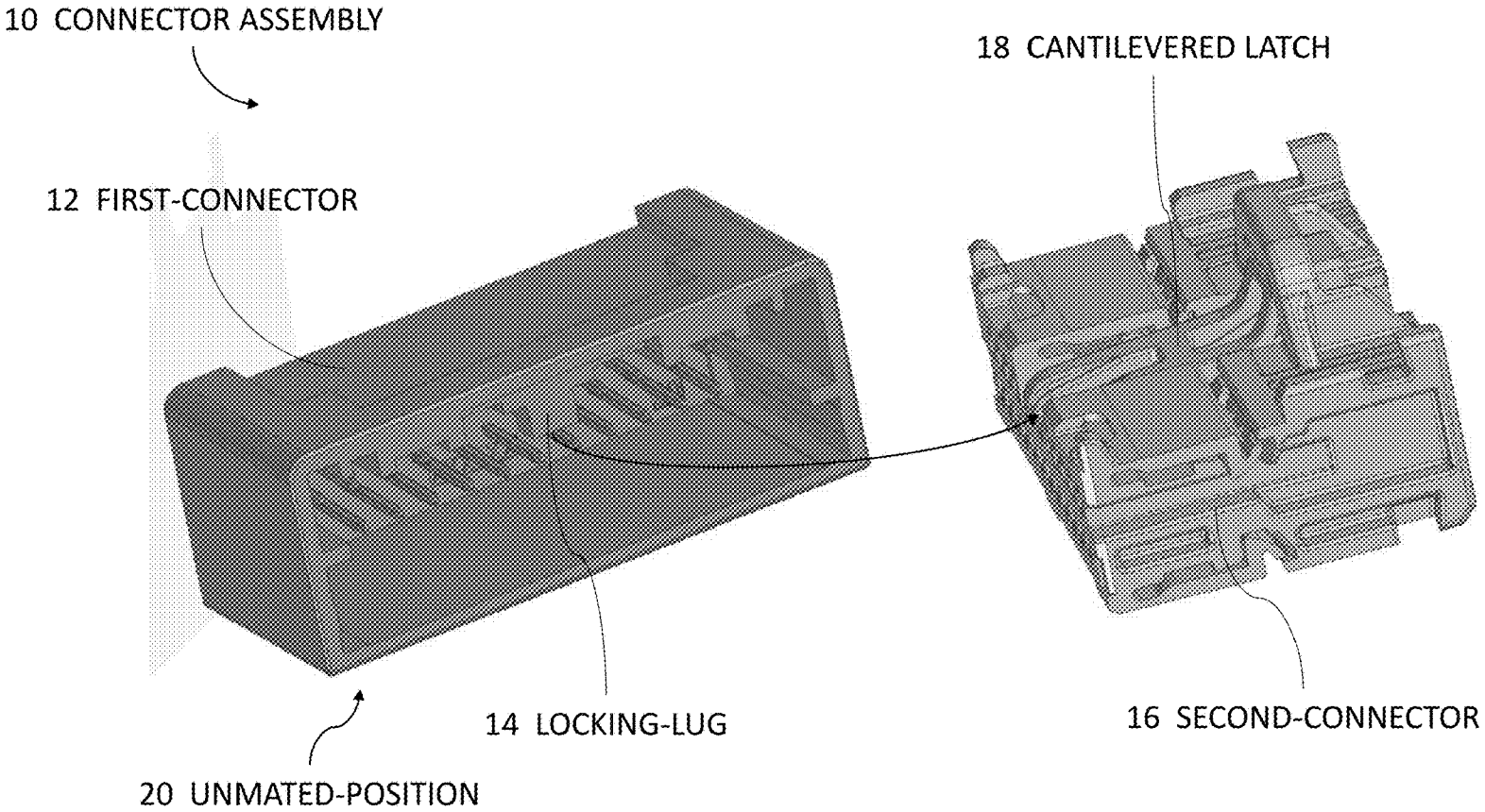
FIG. 1 is an exploded-view of a connector assembly in accordance with one embodiment.

FIG. 1 is an exploded-view illustrating a connector assembly 10, hereafter referred to as the assembly 10. The assembly 10 includes a first-connector 12 having a locking-lug 14 and a second-connector 16 configured to mate with the first-connector 12. The first-connector 12 and the second-connector 16 are formed of a polymeric dielectric material. The dielectric material may be any dielectric material capable of electrically isolating portions of electrical-terminals (not specifically shown) retained by the first-connector 12 and the second-connector 16, and is preferably a polyamide (NYLON) material. The first-connector 12 and/or the second-connector 16 connector may also be formed the polymeric material comprising at least 33% glass-fill. The first-connector 12 and the second-connector 16 are configured to be attached to wire cables (not shown) that may be a component of a wiring-harness of a vehicle. The second-connector 16 includes a cantilevered latch 18 configured to slideably engage the locking-lug 14 when the first-connector 12 is moved from an unmated-position 20 to a mated-position 22 (see FIGS. 5A-5C).

Figure 2:
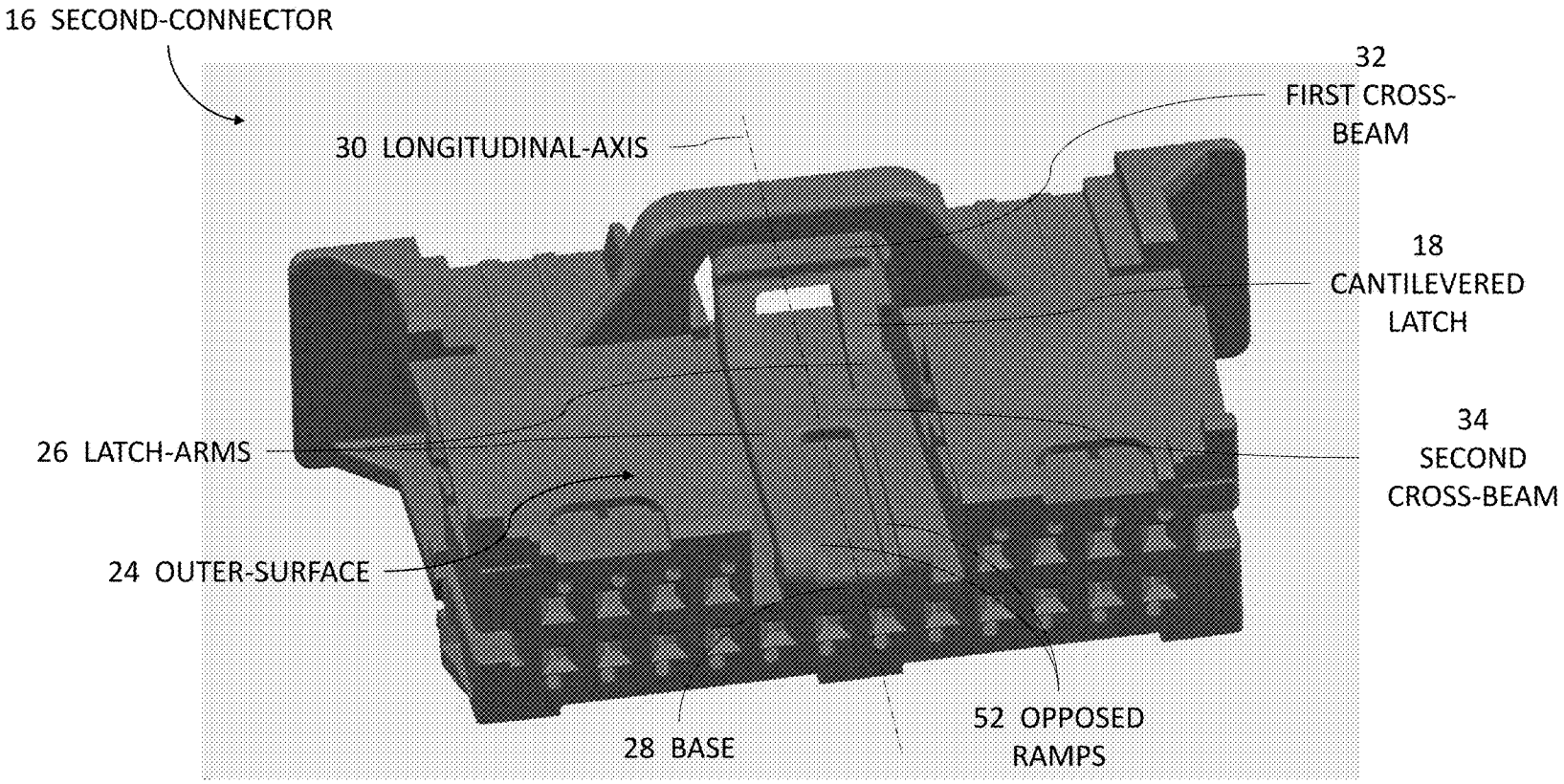
FIG. 2 is a perspective-view of a second-connector of the connector assembly of FIG. 1 in accordance with one embodiment.

FIG. 2 is a perspective-view of the second-connector 16 isolated from the assembly 10 illustrating an outer-surface 24 of the second-connector 16. The cantilevered latch 18 generally has an H-shape and includes a pair of parallel latch-arms 26 extending from a base 28 that is attached to the outer-surface 24. The pair of parallel latch-arms 26 overlay the outer-surface 24 and extend along a longitudinal-axis 30 of the second-connector 16 terminating at a first cross-beam 32 that spans the pair of parallel latch-arms 26. The cantilevered latch 18 also includes a second cross-beam 34 parallel to the first cross-beam 32 that is positioned between the base 28 and the first cross-beam 32, wherein the second cross-beam 34 is configured to releasably lock the locking-lug 14 when the first-connector 12 is in the mated-position 22.

Figure 3:
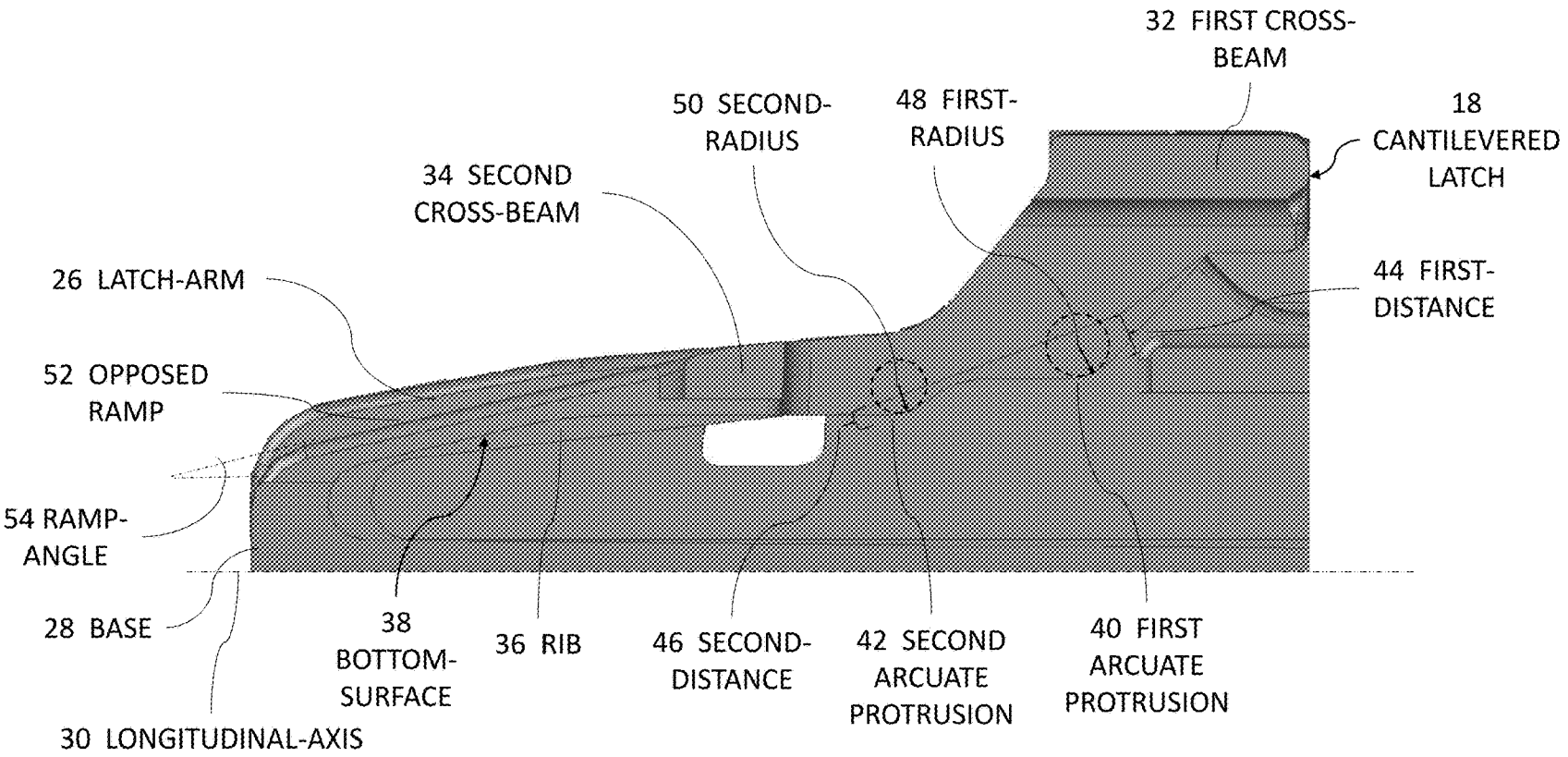
FIG. 3 is a section-view of a cantilevered latch of the second-connector of FIG. 2 in accordance with one embodiment.

FIG. 3 is a section-view of the cantilevered latch 18 along the longitudinal-axis 30 through both the first cross-beam 32 and the second cross-beam 34. Each of the pair of parallel latch-arms 26 includes a rib 36 extending beyond a bottom-surface 38 of each individual latch-arm 26 from the base 28 to the first cross-beam 32. The rib 36 defines a first arcuate-protrusion 40 (i.e., the larger peak) and a second arcuate-protrusion 42 (i.e., the smaller peak), wherein the first arcuate-protrusion 40 is located proximate the first cross-beam 32 and the second arcuate-protrusion 42 is located proximate the second cross-beam 34. As used herein, the term "proximate" includes distances between components of less than 10.0 mm. The first arcuate-protrusion 40 defines a first-distance 44 from the bottom-surface 38 and the second arcuate-protrusion 42 defines a second-distance 46 from the bottom-surface 38, with first-distance 44 being greater than the second-distance 46. The first arcuate-protrusion 40 defines a first-radius 48 in a range between 2.0 mm and 5.0 mm, and the second arcuate-protrusion 42 defines a second-radius 50 a range between 3.0 mm and 6.0 mm.

Figure 4:
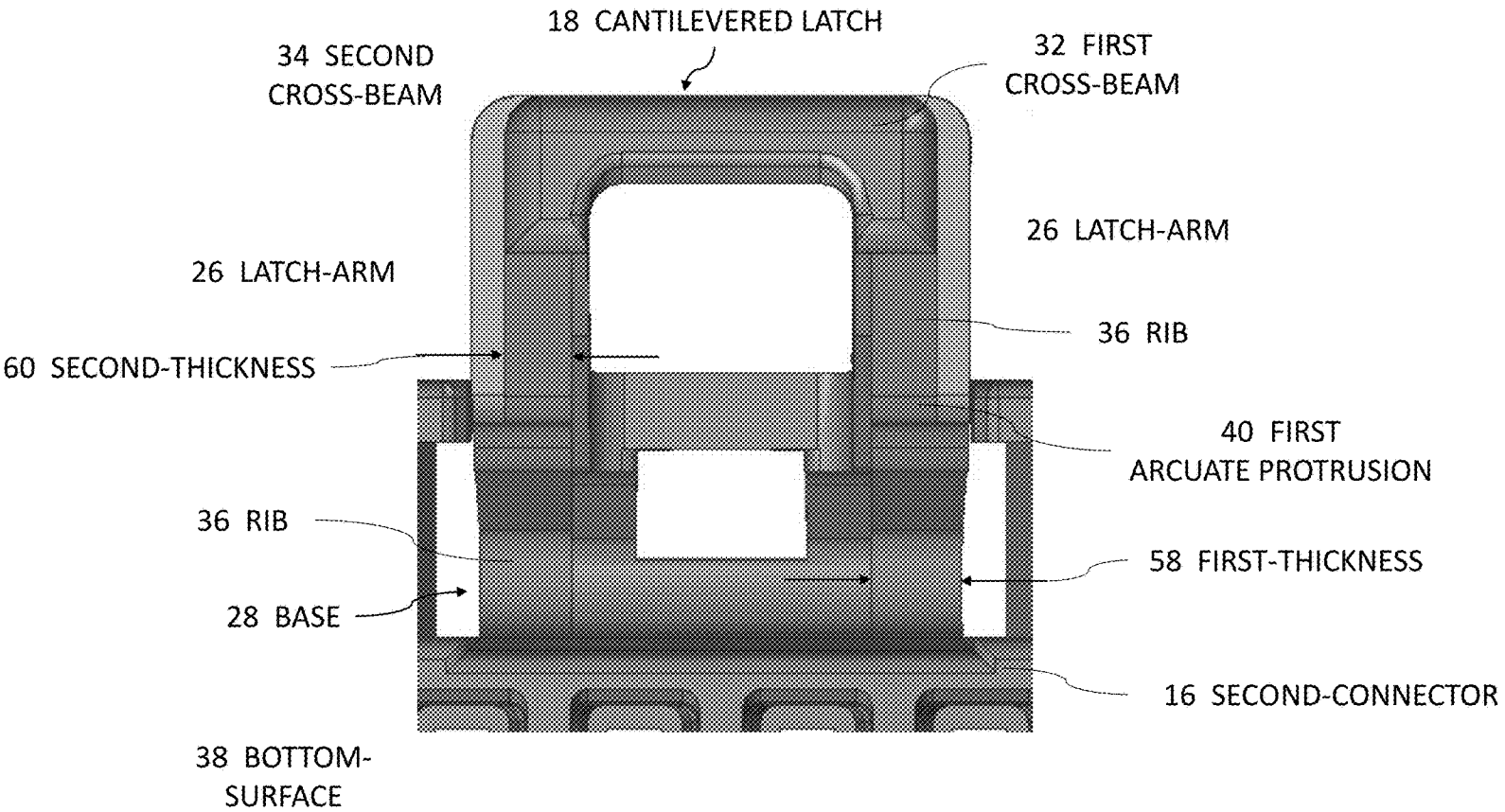
FIG. 4 is a portion of an end-view of the second-connector of FIG. 2 in accordance with one embodiment.

FIG. 4 is a partial end-view of the second-connector 16 with the first cross-beam 32 in the foreground and illustrates the features of the cantilevered latch 18. The rib 36 at the base 28 of the cantilevered latch 18 has a first-thickness 58 in a range between 1.0 mm and 1.2 mm, and has a second-thickness 60 at the first arcuate-protrusion 40 is in a range between 0.7 mm and 0.8 mm.

Referring again to FIG. 3, the pair of parallel latch-arms 26 define opposed ramps 52 formed into medial portions of the parallel latch-arms 26 and are configured to engage the locking-lug 14 during the mating sequence of the first-connector 12 with the second-connector 16. The opposed ramps 52 extend from the base 28 and terminate at the second cross-beam 34, and are characterized as having a ramp-angle 54 that is in a range between 15-degrees and 20-degrees. Experimentation by the inventors has discovered that the ramp-angle 54 in this range enables an engagement-force 56 (see FIGS. 5A-5B) exerted by the cantilevered latch 18 on the locking-lug 14, of less than 6 Newtons when the first-connector 12 is moved from the unmated-position 20 to the mated-position 22.

Figure 5A:
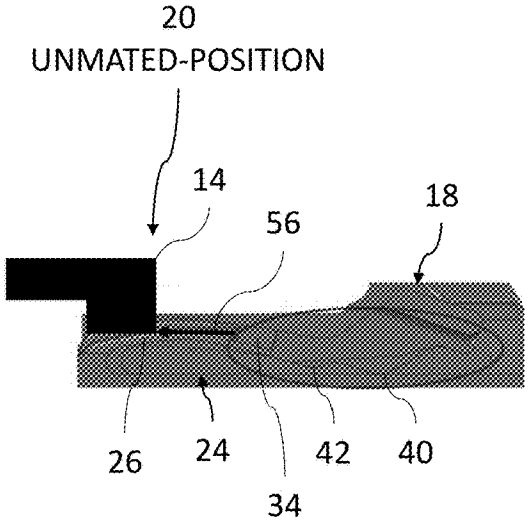
FIG. 5A is a point in a mating sequence of the connector assembly of FIG. 1 in accordance with one embodiment.
Figure 5B:
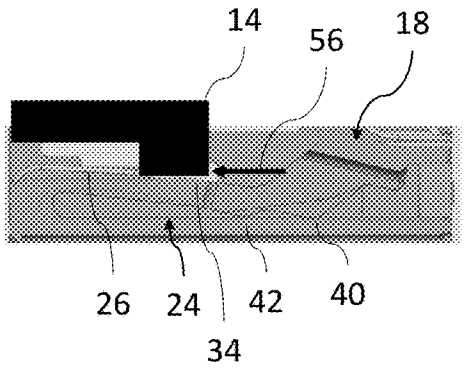
FIG. 5B is another point in the mating sequence of the connector assembly of FIG. 1 in accordance with one embodiment.
Figure 5C:
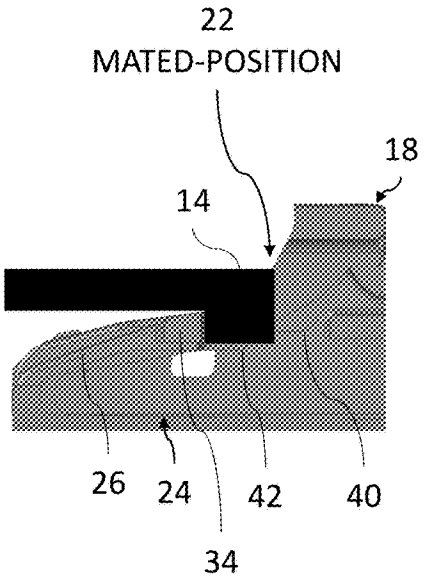
FIG. 5C is yet another point in the mating sequence of the connector assembly of FIG. 1 in accordance with one embodiment.

FIGS. 5A-5C illustrate three segments of the mating sequence as the first-connector 12 is moved from the unmated-position 20 to the mated-position 22. Only the locking-lug 14 of the first-connector 12 is shown in contact with the cantilevered latch 18 for clarity. The locking-lug 14 deflects the pair of parallel latch-arms 26 toward the outer-surface 24 of the second-connector 16 when first-connector 12 is moved from the unmated-position 20 to the mated-position 22.

FIG. 5A illustrates a starting point early in the mating sequence where the locking-lug 14 is deflecting the pair of parallel latch-arms 26 and the first arcuate-protrusion 40 contacts the outer-surface 24 before the second arcuate-protrusion 42 contacts the outer-surface 24 of the second-connector 16.

FIG. 5B illustrates an intermediate point in the mating sequence where the locking-lug 14 overlays (i.e., is directly over) the second cross-beam 34 deflecting the pair of parallel latch-arms 26, whereby both the first arcuate-protrusion 40 and the second arcuate-protrusion 42 contact the outer-surface 24 thereby limiting the deflection of the pair of parallel latch-arms 26. This has the technical benefit of distributing a principal-stress within the pair of parallel latch-arms 26 between the base 28 and the first arcuate-protrusion 40 such that the principal-stress does not exceed a yield-strength of the at least 33% glass-filled polymeric dielectric material. Experimentation by the inventors has discovered that the connector assembly 10 may achieve in excess of ten mating/unmating cycles without a failure of the cantilevered latch 18, which indicates up to a five-fold increase in the cyclic durability of the at least 33% glass-filled polymeric dielectric material.

FIG. 5C illustrates the completion of the mating sequence in which the locking-lug 14 locked to the cantilevered latch 18 indicative of the first-connector 12 being in the mated-position 22, wherein neither the first arcuate-protrusion 40 nor the second arcuate-protrusion 42 contacts the outer-surface 24, thereby placing the cantilevered latch 18 in a stress-free or relaxed state.

Accordingly, a connector assembly 10 (the assembly 10), is provided. The assembly 10 is an improvement over prior art connector assemblies because the assembly 10 may be formed of at least a 33% glass-filled polymeric dielectric material and exhibits improved cyclic durability test results.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

We claim:

1. An electrical connector assembly, comprising:

a first-connector having a locking-lug; and a second-connector configured to mate with the first-connector, said second-connector having a cantilevered latch configured to slideably engage the locking-lug when the first-connector is moved from an unmated-position to a mated-position, said cantilevered latch generally having an H-shape and including a pair of parallel latch-arms extending from a base, said base attached to an outer-surface of the second-connector, said pair of parallel latch-arms overlaying the outer-surface and extending along a longitudinal-axis of the second-connector and terminating at a first cross-beam that spans the pair of parallel latch-arms, said cantilevered latch further including a second cross-beam parallel to the first cross-beam and positioned between the base and the first cross-beam, said second cross-beam configured to releasably lock the locking-lug when the first-connector is in the mated-position, said pair of parallel latch-arms including a rib extending beyond a bottom-surface of each individual latch-arm from the base to the first cross-beam, said rib defining a first arcuate-protrusion and a second arcuate-protrusion, said first arcuate-protrusion located proximate the first cross-beam and the second arcuate-protrusion located proximate the second cross-beam, wherein the locking-lug deflects the pair of parallel latch-arms toward the outer-surface of the second-connector when the first-connector is moved from the unmated-position to the mated-position, whereby the first arcuate-protrusion and the second arcuate-protrusion contact the outer-surface and limit a deflection of the pair of parallel latch-arms;

wherein the first arcuate-protrusion defines a first-radius and the second arcuate-protrusion defines a second-radius that is different from the first radius.

2. The electrical connector assembly in accordance with claim 1, wherein the first arcuate-protrusion contacts the outer-surface before the second arcuate-protrusion contacts the outer-surface when the first-connector is moved from the unmated-position to the mated-position.

3. The electrical connector assembly in accordance with claim 1, wherein both the first arcuate-protrusion and the second arcuate-protrusion are in contact with the outer-surface when the locking-lug overlays the second cross-beam.

4. The electrical connector assembly in accordance with claim 1, wherein neither the first arcuate-protrusion nor the second arcuate-protrusion contacts the outer-surface when the first-connector is in the mated-position.

5. The electrical connector assembly in accordance with claim 1, wherein the first arcuate-protrusion defines a first-distance from the bottom-surface and the second arcuate-protrusion defines a second-distance from the bottom-surface, said first-distance being greater than the second-distance.

6. The electrical connector assembly in accordance with claim 1, wherein the first-radius is in a range between 2.0 mm and 5.0 mm.

7. The electrical connector assembly in accordance with claim 1, wherein the second-radius is in a range between 3.0 mm and 6.0 mm.

8. The electrical connector assembly in accordance with claim 1, wherein the second-connector is formed a polymeric material comprising at least 33% glass-fill.

9. The electrical connector assembly in accordance with claim 1, wherein the pair of parallel latch-arms define opposed ramps formed into medial portions of the pair of parallel latch-arms, said opposed ramps configured to engage the locking-lug, said opposed ramps extending from the base and terminating at the second cross-beam.

10. The electrical connector assembly in accordance with claim 9, wherein the opposed ramps are characterized as having a ramp-angle that is in a range between 15-degrees and 20-degrees.

11. The electrical connector assembly in accordance with claim 1, wherein a first-thickness of the rib at the base is in a range between 1.0 mm and 1.2 mm.

12. The electrical connector assembly in accordance with claim 1, wherein a second-thickness of the rib at the first arcuate-protrusion is in a range between 0.7 mm and 0.8 mm.

13. The electrical connector assembly in accordance with claim 1, wherein the cantilevered latch exerts an engagement-force on the locking-lug of less than 6 Newtons when the first-connector is moved from the unmated-position to the mated-position.

* * * * *